US005343621A

United States Patent [19]

Hildebrand et al.

[11] Patent Number: 5,343,621

[45] Date of Patent: * Sep. 6, 1994

[54] SHAVING APPARATUS

[75] Inventors: Gerhard Hildebrand, Steinbach; Gunther Seidel, Frankfurt am Main; Hans-Eberhard Heintke, Wächtersbach; Klaus Ramspeck, Langen; Reinhold Eichhorn, Idstein-Kröftel; Helmut Dürr, Frankfurt am Main; Wolfgang Franke, Langen; Gebhard Braun, Kelkheim; Manfred Ohle, Walldürn; Roland Ullmann, Offenbach am Main, all of Fed. Rep. of Germany

[73] Assignee: Braun Aktiengesellschaft, Kronberg, Fed. Rep. of Germany

[ * ] Notice: The portion of the term of this patent subsequent to Aug. 17, 2010 has been disclaimed.

[21] Appl. No.: 65,554

[22] Filed: May 20, 1993

Related U.S. Application Data

[62] Division of Ser. No. 931,858, Aug. 18, 1992, Pat. No. 5,235,749.

[30] Foreign Application Priority Data

Aug. 26, 1991 [DE] Fed. Rep. of Germany ..... 4128218

[51] Int. Cl.[5] ..... B26B 19/06; B26B 19/00; B26B 19/14; B26B 21/42

[52] U.S. Cl. ..... 30/43.92; 30/43.1; 30/43.91; 30/89

[58] Field of Search ..... 30/43.1, 34, 89, 43.91, 30/43.92

[56] References Cited

U.S. PATENT DOCUMENTS

| | | | |
|---|---|---|---|
| 3,279,056 | 10/1966 | Andis . | |
| 3,763,558 | 10/1973 | Bauerle . | |
| 4,796,359 | 1/1989 | Oprach et al. | 30/89 |
| 4,922,608 | 5/1990 | Pahl | 30/43.1 |
| 4,930,217 | 6/1990 | Wolf et al. | 30/43.1 |
| 4,941,259 | 7/1990 | Wolf | 30/43.1 |
| 5,159,755 | 11/1992 | Jestadt et al. . | |

FOREIGN PATENT DOCUMENTS

| | | |
|---|---|---|
| 3610736C2 | 3/1986 | Fed. Rep. of Germany . |
| 3926894C1 | 8/1989 | Fed. Rep. of Germany . |
| 506817 | 6/1937 | United Kingdom . |
| 1175459 | 12/1969 | United Kingdom . |

OTHER PUBLICATIONS

Pending U.S. Ser. No. 07/829,068, filed Feb. 6, 1992.

*Primary Examiner*—Richard K. Seidel
*Assistant Examiner*—Paul Heyrana, Sr.
*Attorney, Agent, or Firm*—Fish & Richardson

[57] ABSTRACT

The invention is directed to an electric shaving apparatus having a housing and a shaving head assembly which is adapted to pivot relative to the housing about a pivotal axis Z and is comprised of a shaving head frame, a shaving plane formed by at least one outer cutter having arcuate extensions to the longitudinal sides of the shaving head frame, and of at least one inner cutter operatively associated with the outer cutter and driven by a drive mechanism, wherein the outer cutter is arranged in an outer cutter frame member and the outer cutter frame member is mounted in the shaving head frame so as to be pivotal about the pivotal axis Z.

2 Claims, 4 Drawing Sheets

SHAVING APPARATUS

This is a divisional of copending application Ser. No. 07/931,858, filed Aug. 18, 1992, now U.S. Pat. No. 5,235,749.

This invention relates to an electric shaving apparatus having a housing and a shaving head assembly which is adapted to pivot relative to the housing about a pivotal axis and is comprised of a shaving plane formed by at least one outer cutter and of at least one inner cutter operatively associated with the outer cutter and driven by a drive mechanism.

A shaving apparatus of the type initially referred to is known from DE-A1 36 10 736. The completely enclosed shaving assembly comprises a shaving head frame mounted between two support lugs so as to be pivotal about the pivotal axis Z, the shaving head frame having attached to its one end an outer cutter and to its other end a bottom plate, further comprising an inner cutter disposed between the bottom plate and the outer cutter, the inner cutter being caused to oscillate by drive members provided in the shaving head frame and on the bottom plate, the drive members being operated by the drive means provided in the housing of the shaving apparatus.

It is an object of the present invention to improve upon the shaving head assembly of a shaving apparatus of the type initially referred to.

According to the present invention, this object is accomplished in a shaving apparatus of the type initially referred to in that the outer cutter is arranged in a frame member and the outer cutter frame member is mounted in the shaving head frame so as to be pivotal about the pivotal axis Z, that the shaving head frame is open at the end proximate to the housing for the purpose of receiving the inner cutter directly associated with the drive mechanism and coupled thereto in a manner pivotal about the pivotal axis, and is demountably attachable to the housing. Considering that the frame member equipped with an outer cutter is pivotally mounted in a shaving head frame, the shaving assembly is split into two separable subassemblies including an outer cutter mechanism carried by a shaving head frame and an inner cutter mechanism directly associated with the drive mechanism arranged in the housing of the shaving apparatus. Separating the outer cutter mechanism from the inner cutter mechanism simplifies the construction and allows low-cost manufacture of a shaving assembly pivotal about a pivotal axis. The pivotal capability of the frame member for the outer cutter being relocated in the shaving head frame, the end walls of the shaving head frame assume the function of the support lugs provided in the prior-art specification referred to above, the need for these being accordingly obviated. The shaving head frame is open at the end proximate to the housing, being thus directly seatable down onto the housing and adapted to be coupled thereto in a detachable manner. This accordingly dispenses with the need for the bottom plate required in the shaving head assembly of the prior art, and also for the driving elements provided between the bottom plate and the inner cutter for oscillating the inner cutter.

In a preferred embodiment of the present invention, the outer surfaces of the end walls of the outer cutter frame member are provided parallel to the inner surfaces of the end walls of the shaving head frame.

In another preferred embodiment of the present invention, the geometrical form of the outer surfaces of the end walls of the outer cutter frame member and of the inner surfaces of the end walls of the shaving head frame is formed by a segment of a generated surface of a cone having its point lying on the pivotal axis.

The outer cutter frame member is preferably mounted on the end walls of the shaving head frame by means of two bearing pins so as to be pivotal about the pivotal axis.

A particularly straightforward and low-cost manufacture of the coupling means between the outer cutter frame member and the shaving head frame is characterized in that the bearing pin extending through the end wall of the outer cutter frame member includes a holding groove and is secured to the end wall of the shaving head frame by means of a mounting plate engaging in the holding groove. In a preferred embodiment, a recess as well as at least one holding lug are provided on the outside of the end walls of the shaving head frame. Preferably, at least one of the longitudinal sides of the mounting plate includes an indentation insertable in the holding groove of the bearing pin. At least one indentation is suitably provided on either longitudinal side of the mounting plate.

In a preferred embodiment of the present invention, a tension force is transmittable by the bearing pins having their one ends secured to the end walls of the shaving head frame and their other ends resting against the end walls of the outer cutter frame member.

In a further feature of the present invention, the pivotal movement of the inner cutter about the pivotal axis is accomplished by the action of the pivotally mounted outer cutter on the inner cutter.

In a manufacturing method, a horizontally vibration-free or immovable coupling of the frame member equipped with an outer cutter to the shaving head frame is accomplished in that a device is provided by means of which a pressure is exerted on the opposed end walls of the shaving head frame in a manner reducing the relative distance C of these end walls, in that, with the end walls of the shaving head frame acted on by this pressure, the outer cutter frame member is secured to the end walls of the shaving head frame by means of bearing pins, and that, following removal of the pressure exerted by the device on the end walls, a horizontally immovable mounting of the outer cutter frame member on the bearing pins is obtained by means of the releasing force of the tensioned end walls of the shaving head frame, this force acting through the bearing pins on the outer cutter frame member.

An equally advantageous method of manufacturing a shaving head comprising a shaving head frame and an outer cutter frame member pivotally mounted therein and including at least one outer cutter is characterized in that a device is provided by means of which a pressure is exerted on the opposed end walls of the outer cutter frame member in a manner increasing the relative distance D of the end walls, in that, with the end walls of the outer cutter frame member acted on by this pressure, the outer cutter frame member is secured to the end walls of the shaving head frame by means of bearing pins, and that, following removal of the pressure exerted on the end walls by the device, a horizontally immovable mounting of the outer cutter frame member on the bearing pins is obtained by means of the releasing force of the tensioned end walls of the outer cutter frame member, this force acting through the bearing pins on the shaving head frame.

A preferred embodiment of the present invention will be described in the following with reference to the accompanying drawings. In the drawings, FIG. 1 is a perspective view of a shaving apparatus including a shaving head frame and a pivotally mounted frame member for an outer cutter;

FIG. 1*a* is a perspective view of an outer cutter having two arched shaving surfaces extending parallel to each other;

Figure 4:
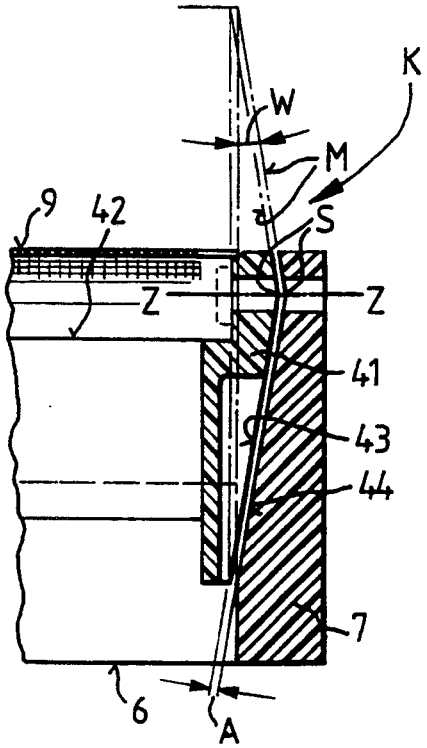
FIG. 4 is a sectional view of the end walls of the shaving head frame and the frame member for the outer cutter.
Figure 4A:
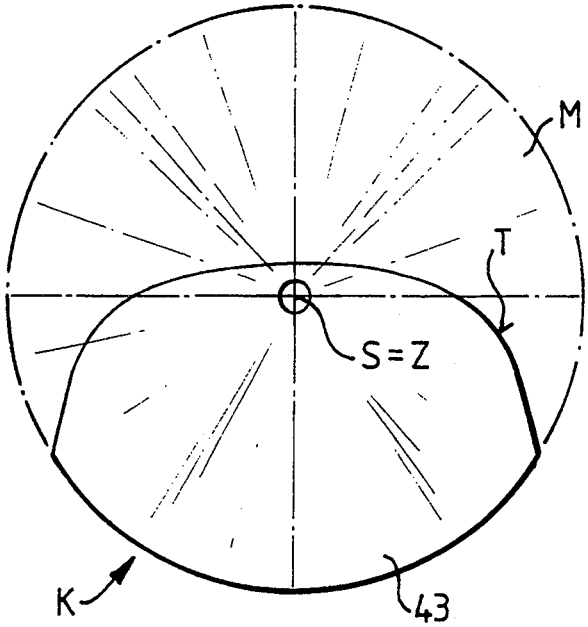
Figure 5:
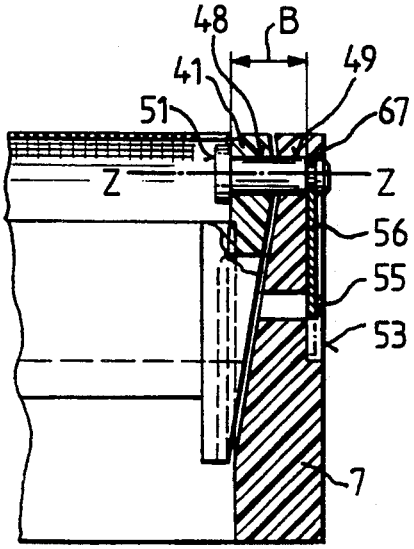
Figure 5A:
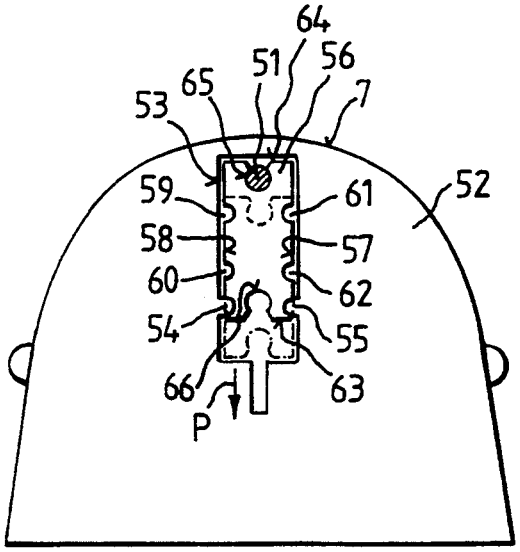

FIG. 4*a* is a view of an end wall of the frame member for the outer cutter;

FIG. 5 is a sectional view of the end walls of shaving head frame and frame member for the outer cutter showing fastening elements; and FIG. 5*a* is a view of an outer wall of the shaving head frame.

Figure 1:
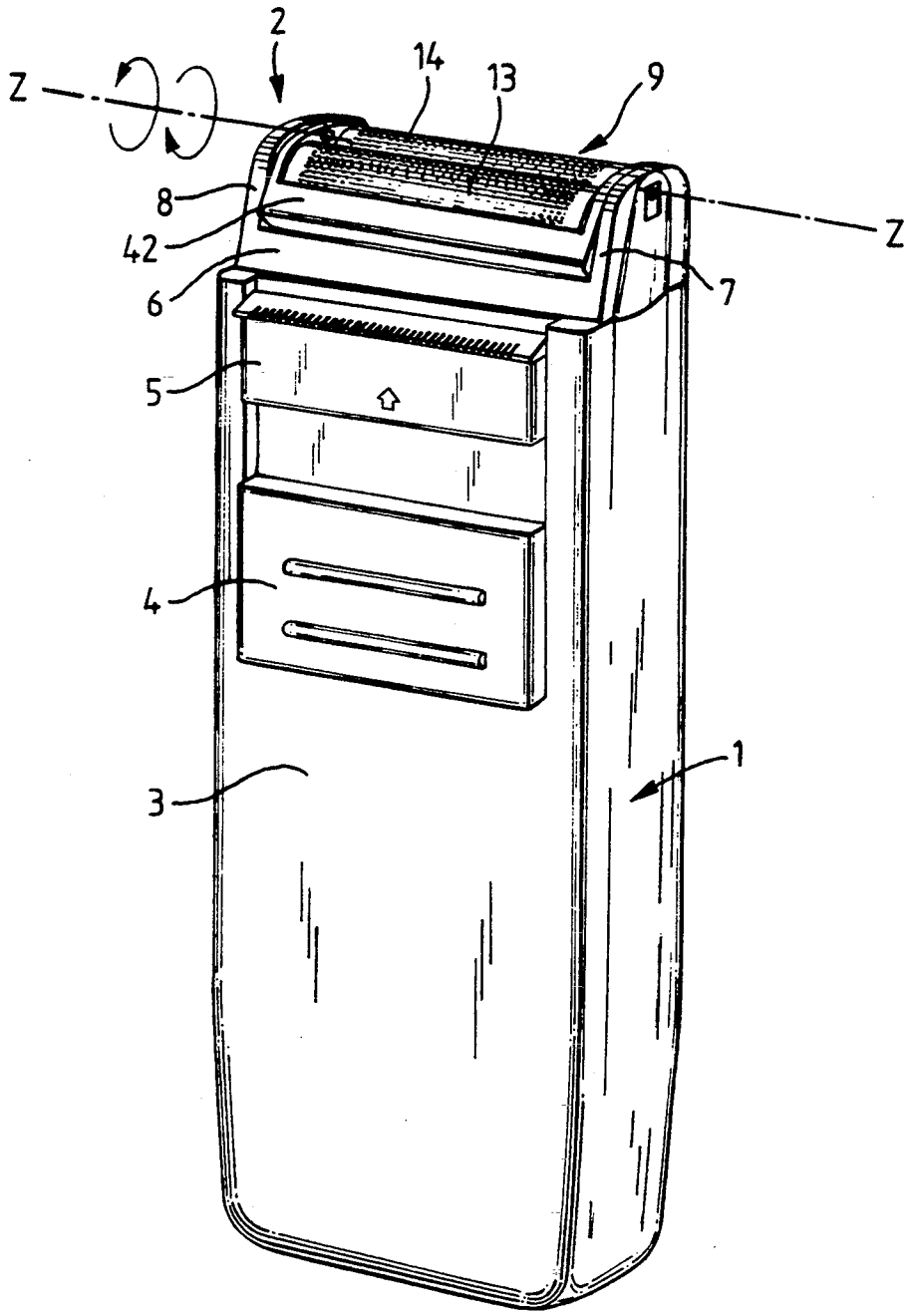

Referring now to FIG. 1 of the drawings, there is shown an electric shaving apparatus having a housing 1 and a shaving head assembly 2 adapted to pivot relative to the housing 1 about a pivotal axis Z, as well as an On-Off switch 4 slidable in the front panel 3 and having associated therewith a slidable long-hair trimmer 5.

Figure 2:
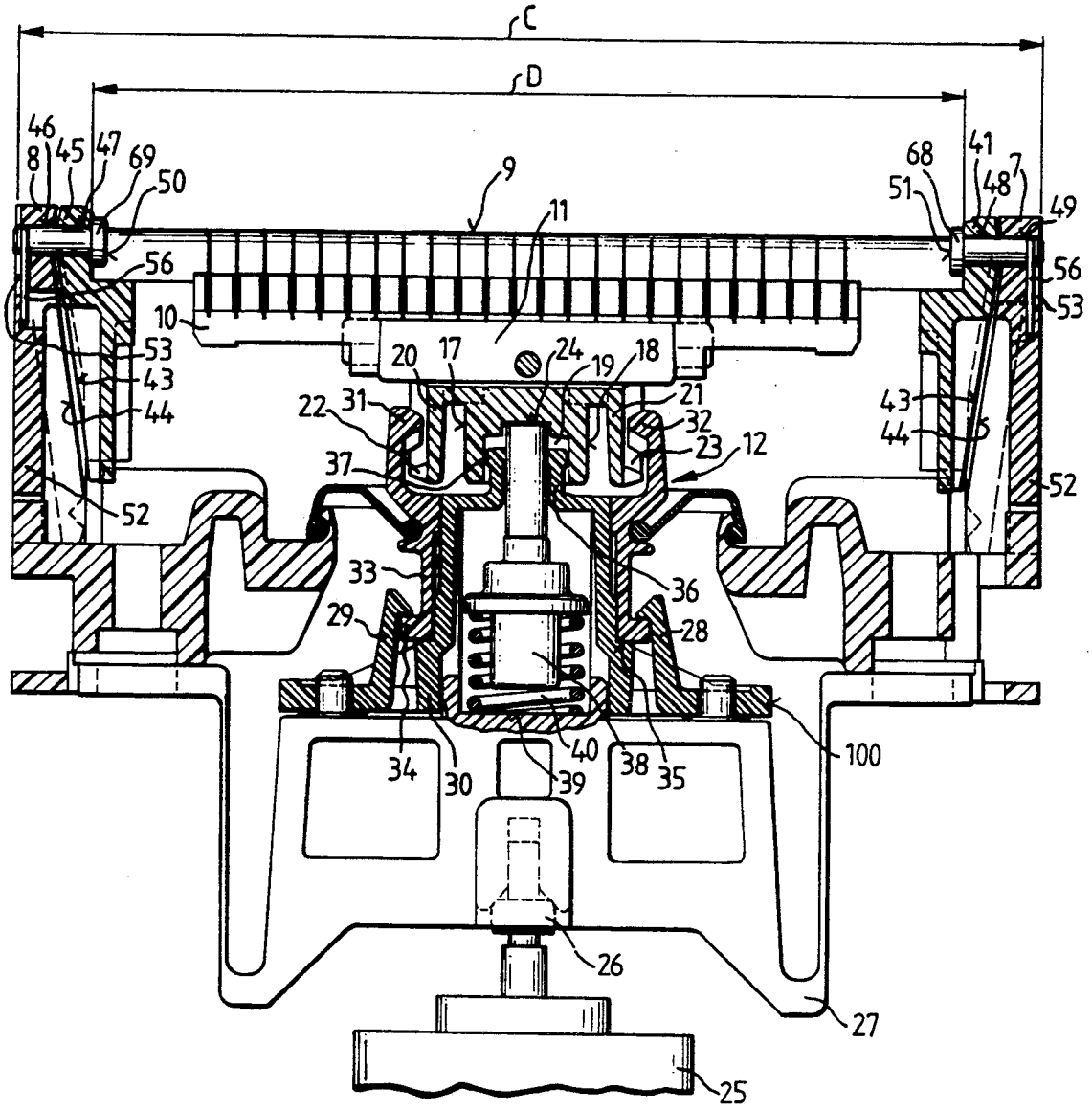
FIG. 2 is a sectional view of a shaving head frame, a frame member for an outer cutter, and a drive mechanism.

The shaving head assembly 2 is comprised of a shaving head frame 6 arranged on the housing 1, an outer cutter 9 mounted intermediate end walls 7, 8 so as to be pivotal about the pivotal axis Z, and an inner cutter 10 —see FIG. 2—engaging the outer cutter 9 and being coupled to a drive mechanism 12 arranged in the housing 1 by means of a coupling member 11 in both a driving and a pivotal relationship about the pivotal axis Z, with the pivotal movement of the inner cutter 10 being accomplished by the action of the pivotally mounted outer cutter 9 on the inner cutter 10.

The shaving head frame 6 is demountably attached to the housing 1 by means of a locking mechanism.

Figure 1A:
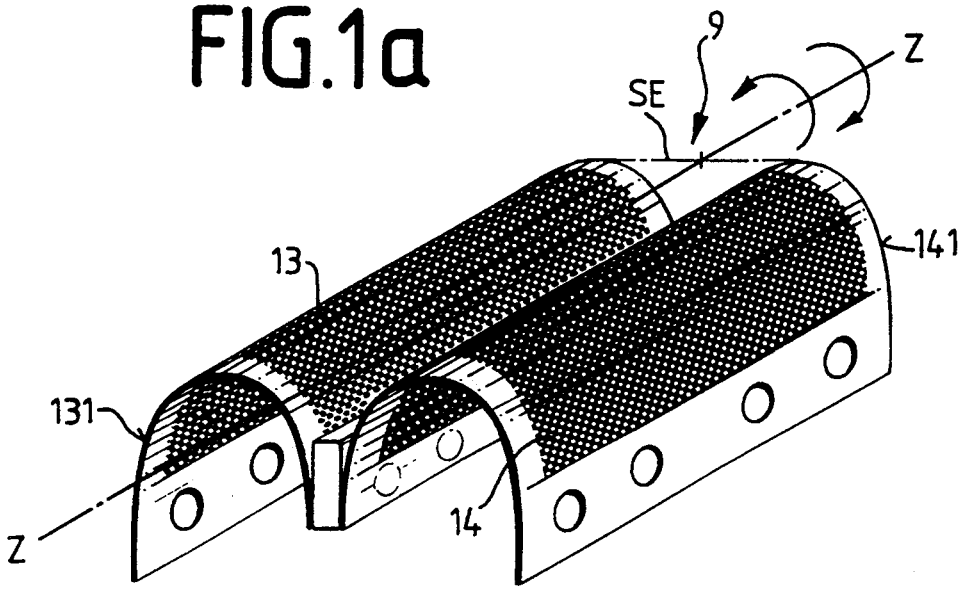

The outer cutter 9 includes two arched shaving surfaces 13, 14 extending parallel to the pivotal axis Z. The tangential plane connecting the arched shaving surfaces 13 and 14 is an imaginary plane referred to as shaving plane SE—see FIG. 1*a*. As becomes apparent from FIG. 3, the shaving surfaces 13 and 14 are formed by two shaving foils 131, 141 attached to the frame member 42 for the outer cutter in arched form. The two shaving foils 131 and 141 are each fastened to a web member 421 provided inside the frame member 42 for the outer cutter and extending parallel to the pivotal axis Z, while their opposed longitudinal sides are coupled to a respective one of the side walls 422, 423 of the frame member 42 for the outer cutter, which side walls extend equally parallel to the pivotal axis.

Figure 3:
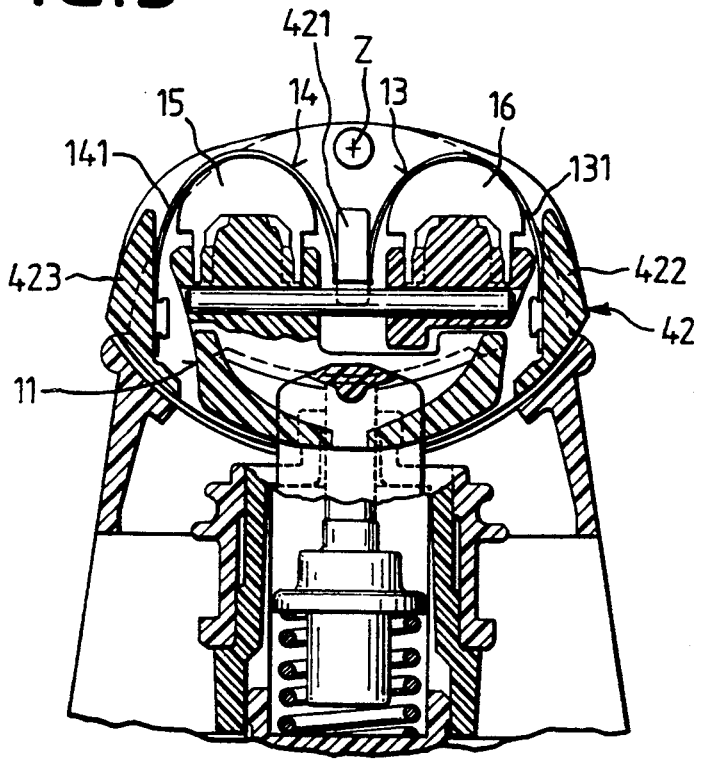
FIG. 3 is a sectional view of a shaving head assembly including a pivotally mounted frame member for an outer cutter.

In an embodiment illustrated in FIG. 3, the inner cutter 10 is comprised of two parallel blade assemblies 15, 16 of arcuate form arranged on the common coupling member 11. As becomes apparent from FIG. 2, at the end proximate to the drive mechanism 12 the coupling member 11 includes four parallel walls, whereof the opposed inner walls 17 and 18 form a U-shaped recess 19 and the two outer walls 20, 21 are each provided with a respective outwardly extending lug 22, 23. In the U-shaped recess 19, another U-shaped recess 24 is provided, its arcuate extent being conformed to the pivotal movement of the outer cutter 9 about the pivotal axis Z.

The drive mechanism 12 is comprised of an oscillating member 27 arranged in the housing 1 and driven by a motor 25 by means of an eccentric member 26, as well as of coupling members mounted on the oscillating member 27, including, for example, a supporting plate 100 having fastening hooks 28, 29 by means of which a drive sleeve 30 and a coupling sleeve 33 having likewise fastening hooks 31, 32 are secured to the supporting plate 100 by engagement with suitable annular shoulders 34, 35. At its end proximate to the inner cutter 10, the drive sleeve 30 has a cylindrical cup 36 with an annular outer bead 37 shaped to correspond to a sector of a sphere. With the inner cutter 10 coupled to the drive sleeve 30, the outer bead 37 is in abutment with the insides of the inner walls 17 and 18, thus ensuring a transmission of the oscillating movement of the oscillating member 27 to the inner cutter 10 and also a seating of the inner cutter 10 on the drive sleeve 30 in a manner permitting pivotal movements. A push rod 38 extending through the cylindrical cup 36 is arranged in the cup-shaped drive sleeve 30. Seated between the upper side 39 of the oscillating member 27 and the push rod 38 is a spring 40 acting on the push rod 38 to maintain it at all times in engagement with the arcuate extent of the recess 24 in the coupling member 11, in order to transmit the force of the spring 40 to the inner cutter 10 for the purpose of resiliently urging the inner cutter 10 into engagement with the outer cutter 9. With its fastening hooks 31, 32, the coupling sleeve 33 surrounding the drive sleeve 30 embraces the lugs 22 and 23 formed on the outer walls 20, 21 of the coupling member 11, and a predetermined flexibility of the fastening hooks 31 and 32 ensures at all times ease of handling, enabling the inner cutter 10 to be readily coupled to, and uncoupled from, the drive mechanism. The fastening hooks 28, 29 are equally of a flexible configuration, thus facilitating the assembly and demounting of push rod 38, spring 40, drive sleeve 30 and coupling sleeve 33 on the oscillating member 27.

FIG. 4 shows a sectional view of the end wall 7 of the shaving head frame 6 and the end wall 41 of the outer cutter frame member 42 with the outer cutter 9. The outer surface 43 of the end wall 41 extends parallel to the inner surface 44 of the end wall 7 at a small relative distance A. The geometrical form of the outer surface 43 and of the inner surface 44 corresponds to a segment T of a generated surface M of a cone K having its point S lying on the pivotal axis Z. The dot-and-dash lines are intended for a better understanding of the generated surface M of the cone K as well as for indication of the cone angle W amounting to 8.5° in the embodiment shown. It will be understood that either a larger or a smaller cone angle W may be selected.

FIG. 4*a* shows the generated surface M of the cone K and the outer surface 43 of the end wall 41 which, as becomes apparent from this illustration, is formed by the segment T of the generated surface M of the cone K. The outer surface 43 of the opposite end wall 45 of the outer cutter frame member 42 and the inner surface 44 of the end wall 8 of the shaving head frame are of the same form as the end walls 7 and 41.

Details of the connection between the outer cutter frame member 42 and the shaving head frame 6 allowing a pivotal movement about the pivotal axis Z are illustrated in FIGS. 2, 5 and 5*a* and will be described in more detail in the following. The end walls 8, 45 and 7, 41 are coupled together by means of bearing pins 50, 51 extending through bearing bores 46, 47, 48, 49. The center axis of the bearing pins 50, 51 lies on the pivotal axis Z. FIGS. 5 and 5a show, for example, the coupling of the end wall 41 to the end wall 7 by means of the bearing pin 51. Provided in the outside 52 of the end wall 7 is a rectangular recess 53 with two holding lugs 54 and 55 integrally formed with the longitudinal sides. The recess 53 accommodates a mounting plate 56 having on either longitudinal side 57, 58 thereof two indentations 59, 60 and 61, 62 in order to enable the mounting plate 56 to be placed into the recess 53 through the holding lugs 54 and 55. The two narrow sides 63, 64 provide each a further indentation 65, 66 serving for engagement with a holding groove 67 provided on the bearing pin 50, 51. The mirror-image arrangement of the indentations 59, 60, 61, 62 and 65, 66 allows a laterally inverted insertion of the mounting plate 56 through the holding lugs 54 and 55 as well as a coupling of the mounting plate 56 to the holding groove 67 of the bearing pin 50, 51 either through the indentation 65 or through the indentation 66. In the embodiment shown, the mounting plate 56 is in engagement with the holding groove 67 of the bearing pin 51, being retained in the recess 53 by means of the holding lugs 54, 55 extending over the mounting plate 56. The indentations 65, 66 are configured such as to perform a clamping or clip function on the bearing pins 51 and 50. By displacing the mounting plate 56 in the direction of arrow P, the bearing pin 51 may be unlocked. The mounting plate 56 then reaches the position indicated in dashed lines in which it may be removed from the recess. This position is at the same time the insertion position for the purpose of displacing and securing the bearing pin 51 in the end wall 7. By means of the bearing bore 49, the end wall 41 is pivotally mounted on the bearing pin 51 about its center axis which is at the same time the pivotal axis Z. The bearing head 68 of the bearing pin 51 acts as a counter support to the mounting formed by the groove 67 and the mounting plate 56, and the distance B which the bearing head 68 assumes relative to the inserted mounting plate 56 determines the distance A shown in FIG. 4 between the outer surface 43 of the end wall 41 and the inner surface 44 of the end wall 7.

The coupling of the respective opposed end walls 7, 41 and 8, 45 by means of the bearing pins 50 and 51 and the mounting plates 56 engaging therein is accomplished in a device by means of which a pressure is exerted on the opposed end walls 7 and 8 of the shaving head frame 6 in a manner reducing the distance C. With the end walls 7 and 8 of the shaving head frame 6 acted on by this pressure, the frame member 42 equipped with an outer cutter 9 is then coupled to the end walls 7 and 8 by insertion of the bearing pins 50 and 51 into the bearing bores 46, 47 and 48, 49 and subsequent locking in position by means of the mounting plates 56. Following release of the pressure exerted on the end walls 7 and 8 by the device, the shaving head frame 6 thus coupled to the outer cutter frame men, her 42 is removed from the device. In this condition, the tensioned end walls 7 and 8 of the shaving head frame 6 transmit their releasing force to the end walls 41 and 45 of the outer cutter frame member 42 through the bearing heads 68, 69 of the bearing pins 50, 51, thereby effecting a horizontally immovable mounting of the outer cutter frame member 42 on the bearing pins 50, 51. By means of this manufacturing method, any manufacturing tolerances occurring in the range of relative cooperation of the end walls 7 and 45 as well as 8 and 41 counterbalance each other, the balance being reached by means of the distance A predetermined by the construction—see FIG. 4. In addition, this manufacturing method provides a horizontally vibration-free and pivotal mounting of the frame member 42 equipped with an outer cutter 9 on the bearing pins 50, 51 secured to the shaving head frame 6. A good cutting performance of outer cutter 9 and inner cutter 10 is thereby ensured.

A further method is equally suitable for obtaining the previously described effects and the advantages to be derived therefrom. This method is characterized in that a device is provided by means of which a pressure is exerted on the opposed end walls 41, 45 of the outer cutter frame member 42 in a direction increasing the distance D, and that the outer cutter frame member 42 acted on by this pressure is coupled to the end walls 7 and 8 by insertion of the bearing pins 50 and 51 into the respective bearing bores 46, 47 and 48, 49 and subsequent locking in position by means of the mounting plates 56. Following removal of the pressure exerted by the device on the end walls 41 and 45, a horizontally immovable mounting of the outer cutter frame member 42 on the bearing pins 50, 51 is obtained by means of the releasing force of the tensioned end walls 41 and 45 of the outer cutter frame member 42, this force acting on the end walls 7 and 8 of the shaving head frame 6 through the bearing pins 50 and 51.

We claim:

1. A method of manufacturing a shaving apparatus that includes housing structure, a drive mechanism in said housing structure, a shaving head assembly adapted to pivot relative to said housing structure about a pivotal axis (Z), said shaving head assembly comprising shaving head frame structure demountably attached to said housing structure, outer cutter structure defining a shaving plane (SE), said outer cutter structure including a frame member, two bearing pins, said outer cutter frame member and said shaving head frame structure each having end wall structures and said outer cutter frame member being mounted on said end wall structures of said shaving head frame by means of said two bearing pins so as to be pivotal about said pivotal axis (Z), said shaving head frame structure having an open end proximate to said housing structure, inner cutter structure received in said shaving head frame structure through said open end for operative association with said outer cutter structure, said inner cutter structure being directly driven by said drive mechanism and coupled thereto in a manner pivotal about said pivotal axis (Z), comprising the steps of exerting pressure on said end wall structures of said shaving head frame structure to reduce the relative distance (C) of said end wall structures, securing said outer cutter frame member to said end wall structure by means of said bearing pins while said end wall structures of said shaving head frame structure are acted on by said pressure, and releasing said pressure exerted on said end wall structures to provide a horizontally immovable mounting of said outer cutter frame member on said bearing pins by the force of the tensioned end wall structures of said shaving head frame structure, said force acting through said bearing pins on said outer cutter frame member.

2. A method of manufacturing a shaving apparatus that includes housing structure, a drive mechanism in said housing structure, a shaving head assembly adapted to pivot relative to said housing structure about a pivotal axis (Z), said shaving head assembly comprising shaving head frame structure demountably attached to said housing structure, outer cutter structure defining a shaving plane (SE), said outer cutter structure including a frame member, two bearing pins, said outer cutter frame member and said shaving head frame structure each having end wall structures and said outer cutter frame member being mounted on said end wall structures of said shaving head frame by means of said two bearing pins so as to be pivotal about said pivotal axis (Z), said shaving head frame structure having an open end proximate to said housing structure, inner cutter structure received in said shaving head frame structure through said open end for operative association with said outer cutter structure, said inner cutter structure being directly driven by said drive mechanism and coupled thereto in a manner pivotal about said pivotal axis (Z), comprising the steps of exerting pressure on said end wall structure of said outer cutter frame member in a manner increasing the relative distance (D) of said end wall structures, securing said outer cutter frame member to said end wall structure by means of said bearing pins while said end walls of said outer cutter frame member are acted on by said pressure, and releasing said pressure exerted on said end wall structures to provide a horizontally immovable mounting of said outer cutter frame member on said bearing pins by the force of said tensioned end wall structures of said outer cutter frame member, said force acting through said bearing pins on said shaving head frame structure.

* * * * *